US010806248B1

(12) United States Patent
Chen

(10) Patent No.: US 10,806,248 B1
(45) Date of Patent: Oct. 20, 2020

(54) SLIDER, FRAME AND TABLE HAVING SAME

(71) Applicant: Inno-Sports Co., Ltd., Xiamen (CN)

(72) Inventor: Renhua Chen, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 0 days.

(21) Appl. No.: 16/838,947

(22) Filed: Apr. 2, 2020

(30) Foreign Application Priority Data

Oct. 9, 2019 (CN) ..... 2019 2 1680806 U

(51) Int. Cl.
*A47B 3/00* (2006.01)
*A47B 3/091* (2006.01)

(52) U.S. Cl.
CPC ..... *A47B 3/0915* (2013.01)

(58) Field of Classification Search
CPC ..... Y10T 292/096; Y10T 292/0995; Y10T 403/32483; Y10T 403/32508; Y10T 403/595; Y10S 292/17; Y10S 292/63; A47B 3/0915; A47B 3/0818; A47B 3/083; A47B 3/0916; A47B 3/0917; A47B 3/0918; A47B 3/0815; A47B 3/0913; A47B 3/087; E04H 15/48; E04H 15/50; E04H 15/46
USPC ..... 248/407, 408, 409, 423, 439, 188.6; 108/115, 160, 126, 129–133, 162, 108/166–169, 171–174, 176, 179; 135/121, 126, 128–131, 140, 144, 146, 135/120.3
See application file for complete search history.

(56) References Cited

U.S. PATENT DOCUMENTS 1,063,642 A * 6/1913 Birdsall ..... A47B 1/08 108/36
2,136,569 A * 11/1938 Trimpi ..... A45B 25/06 135/41
6,508,262 B1 * 1/2003 Takayama ..... E04H 15/50 135/114
6,843,183 B2 1/2005 Strong
7,059,254 B2 6/2006 Strong et al.
7,096,799 B2 8/2006 Strong et al.
7,097,380 B2 * 8/2006 Lee ..... F16B 7/105 15/80
7,171,910 B2 2/2007 Neunzert et al.
7,428,872 B2 9/2008 Strong et al.
7,475,643 B2 1/2009 Haney et al.
(Continued)

FOREIGN PATENT DOCUMENTS

DE 29515948 * 1/1996
EP 1492432 B1 10/2016

*Primary Examiner* — Janet M Wilkens
(74) *Attorney, Agent, or Firm* — Morgan, Lewis & Bockius LLP

(57) ABSTRACT

Disclosed are sliders, and frames and tables having sliders. A slider includes a sleeve, a pivoting portion and a controller. The sleeve is configured to slidably couple with a first bar, and a first hole and a pillar are formed at a first side wall of the sleeve. The pivoting portion is integrally formed or coupled with a second side wall of the sleeve, and configured to pivotally couple with a second bar. The controller is configured to control movement of the sleeve along the first bar. The controller includes a casing, a lever pivotally connected with the casing, a pin integrally formed or coupled with the lever, and an elastic member selectively pushing the pin into the first hole and a hole of the first bar, thereby restricting movement of the sleeve with respect to the first bar.

20 Claims, 9 Drawing Sheets

(56) References Cited

U.S. PATENT DOCUMENTS 7,475,644 B2 1/2009 Strong et al.
7,634,969 B2 12/2009 Neunzert et al.
7,640,870 B2 1/2010 Strong et al.
7,644,667 B2 1/2010 Strong et al.
7,735,431 B2 6/2010 Neunzert et al.
7,874,303 B2 * 1/2011 Xie ..... E04H 15/46 135/120.3
8,006,630 B2 8/2011 Strong et al.
8,033,228 B2 10/2011 Haney et al.
8,042,475 B2 10/2011 Larcom et al.
8,156,875 B2 4/2012 Neunzert et al.
8,302,541 B2 11/2012 Haney et al.
8,342,107 B2 1/2013 Mover et al.
8,534,205 B1 9/2013 Johnson et al.
8,578,865 B2 11/2013 Haney et al.
8,622,007 B2 1/2014 Peery et al.
8,746,155 B2 6/2014 Haney et al.
8,757,069 B2 6/2014 Peery et al.
9,027,952 B2 * 5/2015 Zhu ..... B62B 7/142 280/642
D748,418 S 2/2016 Johnson et al.
9,277,808 B2 3/2016 Cai et al.
D756,694 S 5/2016 Johnson et al.
9,351,563 B2 5/2016 Bennett et al.
10,470,561 B2 11/2019 Clegg et al.
2003/0089286 A1 * 5/2003 Wang ..... A47B 3/0915 108/128
2005/0097829 A1 * 5/2005 Seo ..... E04H 15/50 52/79.1
2005/0241550 A1 * 11/2005 Neunzert ..... A47B 3/00 108/129
2005/0279260 A1 * 12/2005 Stanford ..... A47B 13/021 108/115
2013/0000528 A1 * 1/2013 Jin ..... A47B 3/0915 108/127
2014/0030012 A1 * 1/2014 Lee ..... E04H 15/50 403/326
2014/0099155 A1 * 4/2014 Chen ..... E04H 15/46 403/83
2014/0130837 A1 * 5/2014 Sy-Facunda ..... E04H 15/50 135/120.3
2016/0348395 A1 * 12/2016 Jin ..... E04H 15/26
2019/0150608 A1 5/2019 Johnson et al.
2019/0284831 A1 * 9/2019 Volin ..... E04H 15/54
2019/0292808 A1 * 9/2019 Dotterweich ..... E04H 15/32

* cited by examiner

SLIDER, FRAME AND TABLE HAVING SAME

CROSS-REFERENCE TO RELATED APPLICATIONS

The present application claims priority to Chinese Utility Model Application CN 201921680806.4 filed Oct. 9, 2019. The disclosure of the application is incorporated herein for all purposes by reference in its entirety.

FIELD OF THE INVENTION

The present invention generally relates to control mechanisms, frames and tables, and in particular to sliders, and frames and tables having sliders.

BACKGROUND

Most of existing tables are not foldable. Some of existing tables are foldable but require assembling by end users. Of existing tables, tabletops and supporting legs are usually packaged separately. They are inconvenient for transportation and storage. Moreover, they require assembling of the tabletops and the legs by end users, which are usually time consuming and sometimes difficult and unmanageable.

Given the current state of the art, there remains a need for control mechanisms, frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides control mechanisms such as sliders, and frames and tables having such sliders.

In various exemplary embodiments, the present disclosure provides a slider including a sleeve, a pivoting portion and a controller. The sleeve is configured to slidably couple with a first bar and including a first side wall and a second side wall, wherein a first hole and a pillar are formed at the first side wall of the sleeve. The pivoting portion is integrally formed or coupled with the second side wall of the sleeve, and configured to pivotally couple with a second bar. The controller is configured to control movement of the sleeve along the first bar. The controller includes a casing, a lever, a pin and an elastic member. The casing is integrally formed or coupled with the first side wall of the sleeve and surrounds the first hole and the pillar formed at the first side wall of the sleeve. The lever includes a first end portion, a second end portion, and a middle portion between the first and second portions. The first end portion is aligned with the first hole formed at the first side wall of the sleeve, the second end portion is aligned with the pillar formed at the first side wall of the sleeve, and the middle portion is pivotally connected with the casing. The pin is integrally formed or coupled with the first end portion of the lever, wherein the pin has a free end toward the first hole formed at the first side wall of the sleeve. The elastic member is engaged with the pillar formed at the first side wall of the sleeve, and has a first end abutting the first side wall of the sleeve and a second end abutting the second portion of the lever. When the first hole formed at the first side wall of the sleeve aligns with a hole of the first bar, the elastic member pushes the pin into the first hole formed at the first side wall of the sleeve and the hole of the first bar, thereby restricting movement of the sleeve with respect to the first bar.

In some exemplary embodiments, the first hole and the pillar are formed at the first side wall of the sleeve side by side along the longitudinal direction of the sleeve.

In an exemplary embodiment, the first and second side walls of the sleeve are opposite to each other.

In some exemplary embodiments, the first bar is a leg of a table.

In some exemplary embodiments, a notch is formed at an end portion of the first side wall of the sleeve and configured to couple with a third bar.

In some exemplary embodiments, a protrusion is formed at the second side wall of the sleeve to facilitate easy pushing of the slider along the first bar.

In some exemplary embodiments, the lever is pivotally coupled with the casing by a rod that passes through a hole formed at a middle portion of the casing and a hole formed at the middle portion of the lever.

In an exemplary embodiment, the pin is coupled with the first end portion of the lever by a rod that passes through a hole formed at the first portion of the lever and a hole formed at the pin.

In some exemplary embodiments, pressing the second portion of the lever toward the sleeve removes the pin from the hole of the first bar or from the hole of the first bar and the first hole formed at the first side wall of the sleeve, thereby allowing the sleeve to move along the first bar.

In an exemplary embodiment, the second portion of the lever includes an protrusion outside of the casing to facilitate the pressing of the second portion.

In various exemplary embodiments, the present disclosure provides a frame including a first longitudinal bar, a second longitudinal bar, a first lateral bar, a second lateral bar, a plurality of legs, and a plurality of sliders. The first longitudinal bar is disposed at a first side of the frame. The second longitudinal bar is disposed at a second side of the frame and substantially parallel to the first longitudinal bar. The first lateral bar is disposed at a third side of the frame and having a first end pivotally connected with the first longitudinal bar and a second end pivotally connected with the second longitudinal bar. The second lateral bar is disposed at a fourth side of the frame and having a first end pivotally connected with the first longitudinal bar and a second end pivotally connected with the second longitudinal bar. Each leg in the plurality of legs has an end fixedly connected with the first or second lateral bar. Each oblique in the plurality of oblique bars has a first end and a second end, wherein the first end of each respective oblique bar in the plurality of oblique bars is pivotally connected with the first or second longitudinal bar. Each slider in the plurality of sliders includes a sleeve, a pivoting portion and a controller. The sleeve is slidably coupled with a corresponding leg in the plurality of legs, wherein a first hole and a pillar are formed at a first side wall of the sleeve. The pivoting portion is integrally formed or coupled with a second side wall of the sleeve, and pivotally coupled with the second end of an oblique bar in the plurality of oblique bars. The controller is configured to control movement of the sleeve along the first or second longitudinal bar. The controller include a casing, a lever, a pin and an elastic member. The casing is integrally formed or coupled with the first side wall of the sleeve and surrounds the first hole and the pillar formed at the first side wall of the sleeve. The lever includes a first end portion, a second end portion and a middle portion between the first and second portions. The first end portion is aligned with the first hole formed at the first side wall of the sleeve, the second end portion is aligned with the pillar formed at the first side wall of the sleeve, and the middle portion is pivotally connected with the casing. The pin is integrally formed or coupled with the first end portion of the lever, wherein the pin has a free end toward the first hole formed at the first side wall of the sleeve. The elastic member is engaged with the pillar formed at the first side wall of the sleeve, and has a first end abutting the first side wall of the sleeve and a second end abutting the second portion of the lever. When the first hole formed at the first side wall of the sleeve aligns with a hole of the first or second longitudinal bar, the elastic member pushes the pin into the first hole formed at the first side wall of the sleeve and the hole of the first or second longitudinal bar, thereby restricting movement of the sleeve with respect to the first or second longitudinal bar.

In some exemplary embodiments, the frame further includes one or more interior lateral bars spaced apart from the first and second lateral bars, wherein each interior bar in the one or more interior bars has a first end connected with the first longitudinal bar and a second end connected with the second longitudinal bar.

In an exemplary embodiment, the one or more interior lateral bars includes a middle interior lateral bar disposed in a middle of the frame.

In some exemplary embodiments, the frame further includes a first leg lateral bar and a second leg lateral bar. The first leg lateral bar is disposed between and fixedly connected with two legs that are connected with the first lateral bar. The second leg lateral bar is disposed between and fixedly connected with two legs that are connected with the second lateral bar. Of each slider in the plurality of sliders, a notch is formed at an upper end portion of the first side wall of the sleeve and configured to couple with the first or second leg lateral bar when the legs are unfolded.

In an exemplary embodiment, each slider in the plurality of sliders is coupled with the corresponding leg such that the controller faces an interior side of the frame and the pivoting portion faces an exterior side of the frame.

In some exemplary embodiments, each of the first and second bars is formed with an oval or oblong hole at a distal end thereof, and each of the first and second lateral bars includes an end portion of an oval or oblong cross-section at each of the first and second sides of the frame to couple with the oval or oblong hole.

In some exemplary embodiments, a length of each leg in the plurality of legs is adjustable.

In various exemplary embodiments, the present disclosure provides a table including a frame (any frame disclosed herein) and a tabletop coupled with the frame and supported by the frame when in use.

In some exemplary embodiments, each of the first and second longitudinal bars is a unitary bar and the tabletop is a unitary panel.

In some exemplary embodiments, the frame includes one or more interior lateral bars spaced apart from the first and second lateral bars, wherein each interior bar in the one or more interior bars has a first end connected with the first longitudinal bar and a second end connected with the second longitudinal bar. Corresponding to an interior lateral bar in the one or more interior lateral bars, the tabletop includes one or more slots to receive the interior lateral bar.

The sliders, and frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of sliders, frames having sliders, and tables having one or more such frames. The frames and tables of the present disclosure can be of various sizes. For instance, a frame of the present disclosure can be configured for a coffee table, a dining table, or the like, and can be of a square or rectangular shape. They can be made of various materials including but not limited to metals (e.g., iron, steel, and aluminum), plastics and woods.

Figure 1:
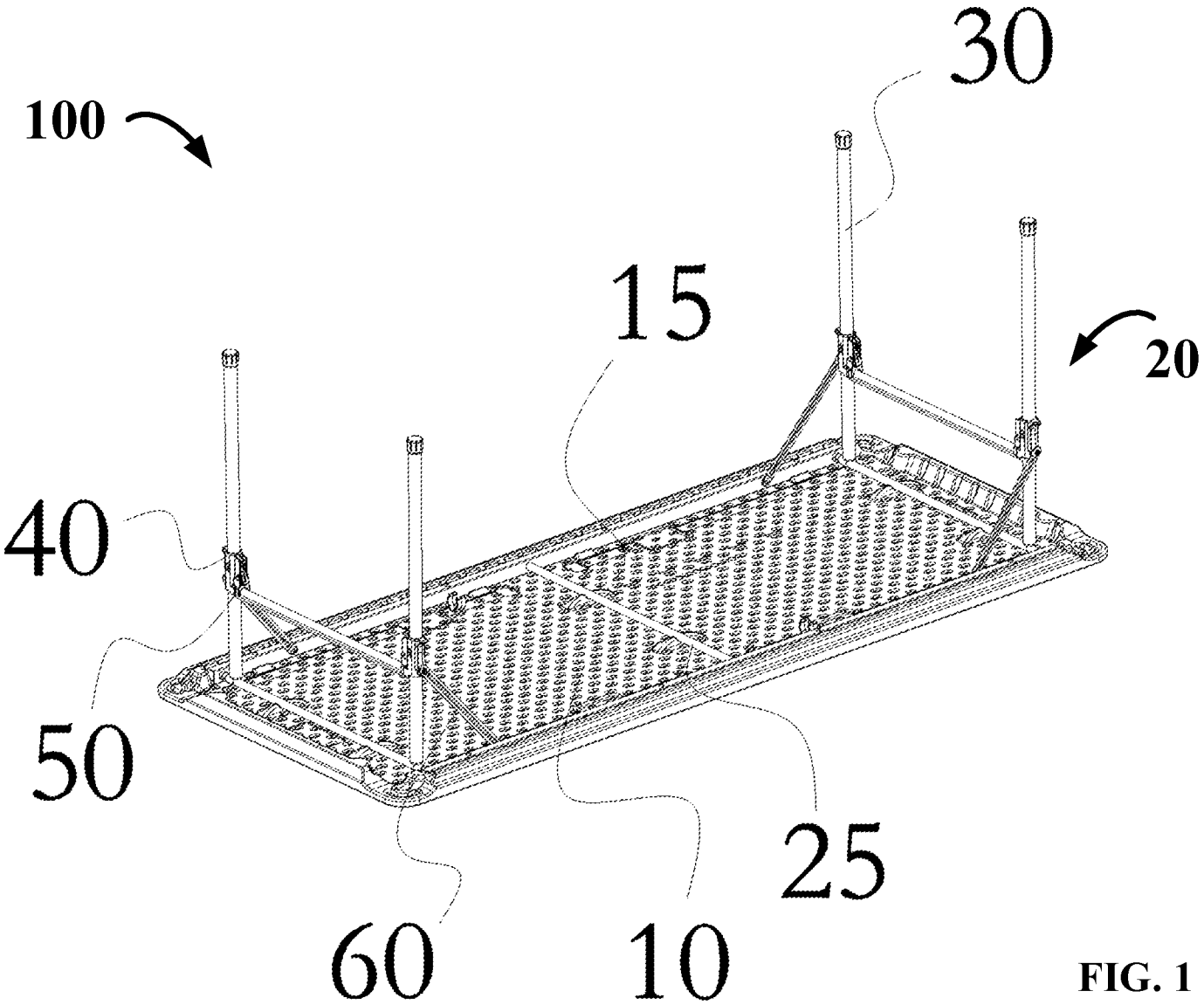
FIG. 1 is a bottom perspective view illustrating an exemplary table in accordance with exemplary embodiments of the present disclosure.

Referring to FIG. 1, there is depicted an exemplary table in accordance with some embodiments of the present disclosure. As shown, table 100 includes a tabletop such as tabletop 10 and a frame such as frame 20 coupled with the tabletop and supporting the tabletop when in use.

Figure 2:
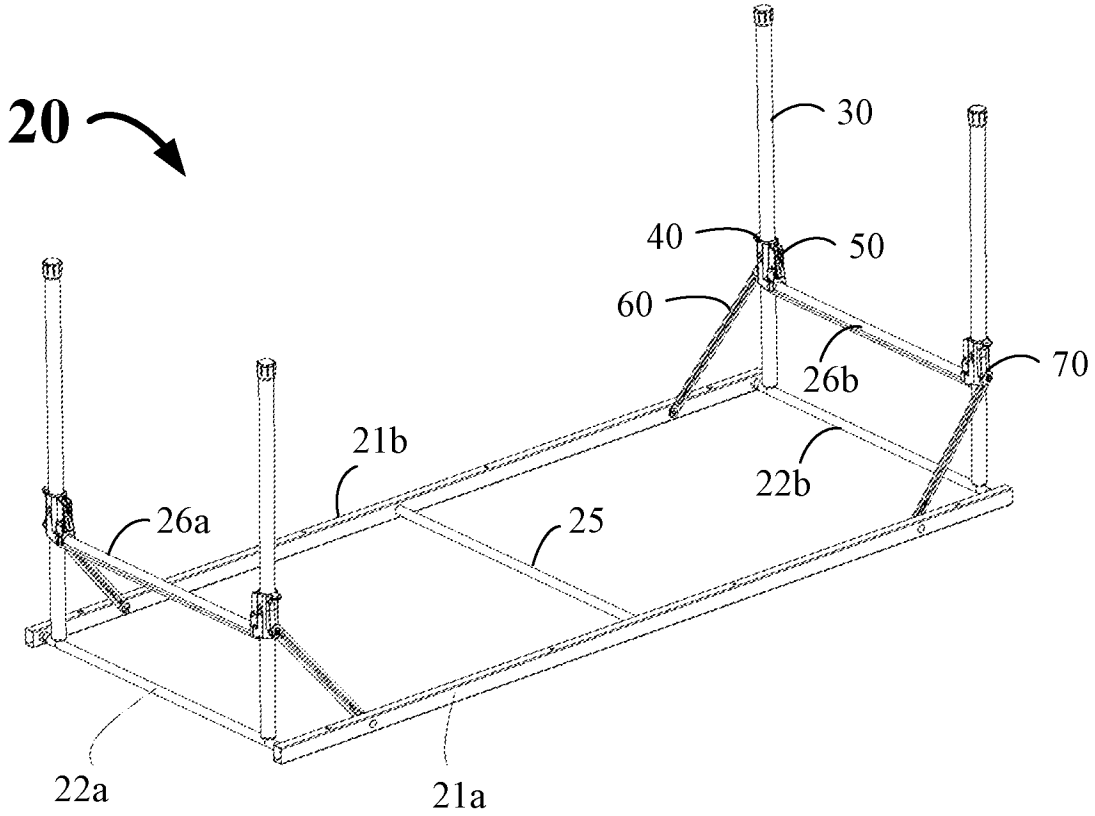
FIG. 2 is a bottom perspective view illustrating an exemplary frame in an unfolded state in accordance with exemplary embodiments of the present disclosure.
Figure 3:
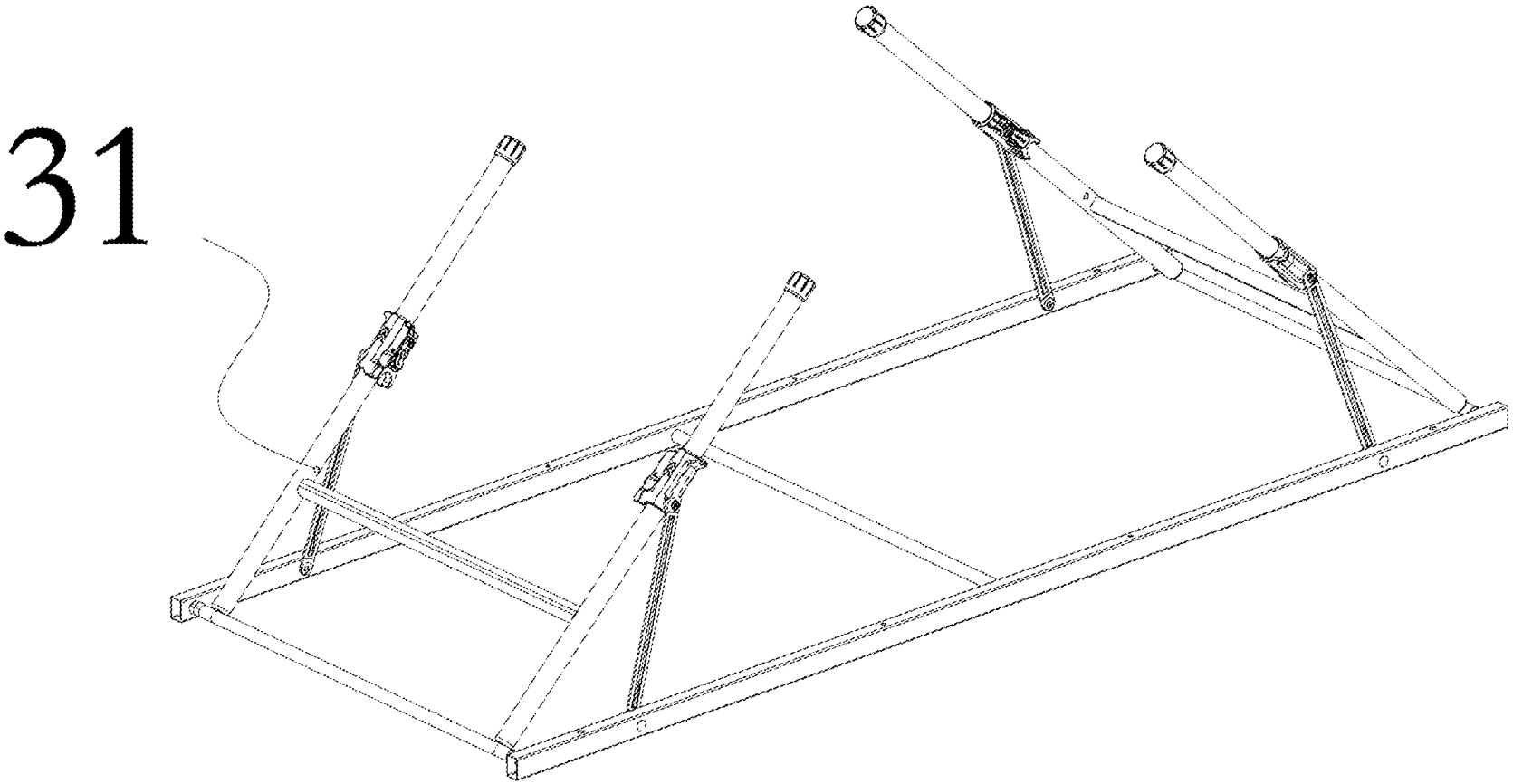
FIG. 3 is a bottom perspective view illustrating the exemplary frame of in FIG. 2 in an intermediate state in accordance with exemplary embodiments of the present disclosure.
Figure 4:
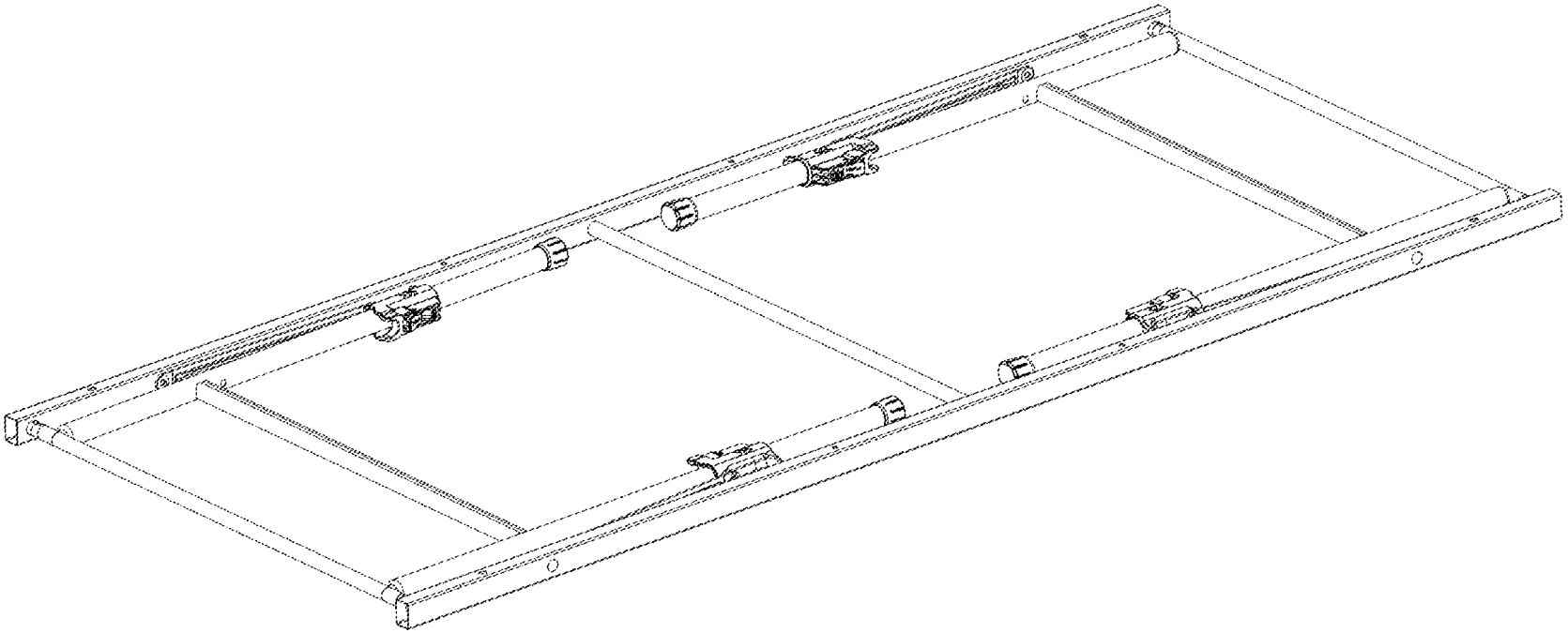
FIG. 4 is a bottom perspective view illustrating the exemplary frame of in FIG. 2 in a folded state in accordance with exemplary embodiments of the present disclosure.

Referring to FIGS. 2-4, frame 20 includes a first longitudinal bar such as first longitudinal bar 21*a* disposed at a first side of the frame and a second longitudinal bar such as second longitudinal bar 21*b* disposed at a second side of the frame and substantially parallel to the first longitudinal bar. It should be noted that the term "side" does not necessarily mean an outmost edge of a frame or an outmost edge of a table. In an exemplary embodiment, first longitudinal bar 21*a*, second longitudinal bar 21*b* or each of first longitudinal bar 21*a* and second longitudinal bar 21*b* is made of a unitary bar, and tabletop 10 is made of a unitary panel.

Frame 20 also includes a first lateral bar such as first lateral bar 22*a* disposed at a third side of the frame and a second lateral bar such as second lateral bar 22*b* disposed at a fourth side of the frame. Each of the first and second lateral bars has a first end pivotally connected with the first longitudinal bar and a second end pivotally connected with the second longitudinal bar.

In some exemplary embodiments, frame 20 includes one or more interior lateral bars spaced apart from the first and second lateral bars, and each interior lateral bar has a first end connected with the first longitudinal bar and a second end connected with the second longitudinal bar. In some exemplary embodiments, corresponding to an interior lateral bar in the one or more interior lateral bars, tabletop 10 includes one or more slots to receive the interior lateral bar.

For instance, by way of example, FIG. 2 illustrates frame 20 including interior lateral bar 25 disposed the first and second lateral bars and connected with the first and second longitudinal bars, and tabletop 10 includes two slots 15 to receive interior lateral bar 25. In an exemplary embodiment, interior lateral bar 25 is disposed in the middle of the frame. It should be noted that the term "middle" as used herein does not necessarily mean the center of the frame.

Frame 20 further includes a plurality of legs such as legs 30, each having an end fixedly connected with the first or second lateral bar. For instance, in an exemplary embodiment, frame 20 includes four legs, two connected with the first lateral bar and two connected with the second lateral bar. In some exemplary embodiments, frame 20 further includes one or more leg lateral bars such as first leg lateral bar 26*a* and second leg lateral bar 26*b*. First leg lateral bar 26*a* is disposed between and fixedly connected with the two legs that are connected with the first lateral bar, and second leg lateral bar 26*b* is disposed between and fixedly connected with the two legs that are connected with the second lateral bar.

In some exemplary embodiments, the length of leg 30 is adjustable, for instance, by having an upper leg and a lower leg that are telescopically connected with each other. Examples of such adjustable legs are disclosed in CN 201921680600.1 filed Oct. 9, 2019 and CN 201921686275.X filed Oct. 9, 2019. The disclosure of each application is incorporated herein for all purposes by reference in its entirety. With adjustable legs, the table can be placed at different heights to meet different needs of different users.

To enhance the strength and stability of the table, in various exemplary embodiments, frame 20 includes a plurality of oblique bars such as oblique bar 60 and a plurality of sliders such as slider 40. For instance, in an exemplary embodiment, frame 20 includes four oblique bars 60 and four sliders 40. Each oblique bar 60 has one end pivotally connected with a corresponding first or second longitudinal bar and the other end pivotally connected with a corresponding slider that is slidably coupled with a corresponding leg in the plurality of legs.

For instance, in some exemplary embodiments, slider 40 includes a pivoting portion such as pivoting portion 70 configured to pivotally couple with oblique bar 60. Slider 40 also includes a control mechanism such as controller 50 that selectively allows the slider to move along the leg or restricts the slider from moving with respect to the leg. For instance, in some exemplary embodiments, controller 50 engages with a hole or slot such as hole or slot 31 formed at the corresponding leg to restrict the slider from moving with respect to the leg. Disengaging controller 50 from hole or slot 31 allows the slider to move along the leg, and consequently allows the leg to fold or unfold.

In some exemplary embodiments, each slider 40 is disposed at the corresponding leg below first leg lateral bar 26*a* or second leg lateral bar 26*b* (FIGS. 2 and 3 show the sliders above first leg lateral bar 26*a* or second leg lateral bar 26*b* because they are bottom perspective views of the frame). In such embodiments, each of first leg lateral bar 26*a* and second leg lateral bar 26*b* serves as a stopper and prevents the corresponding slider from moving further toward the top of the leg. As a result, this prevents the plurality of legs from rotating beyond its unfolded state.

In an exemplary embodiment, each slider 40 is coupled with the corresponding leg such that controller 50 faces an interior side of the frame and pivoting portion 70 faces an exterior side of the frame.

Figure 7:
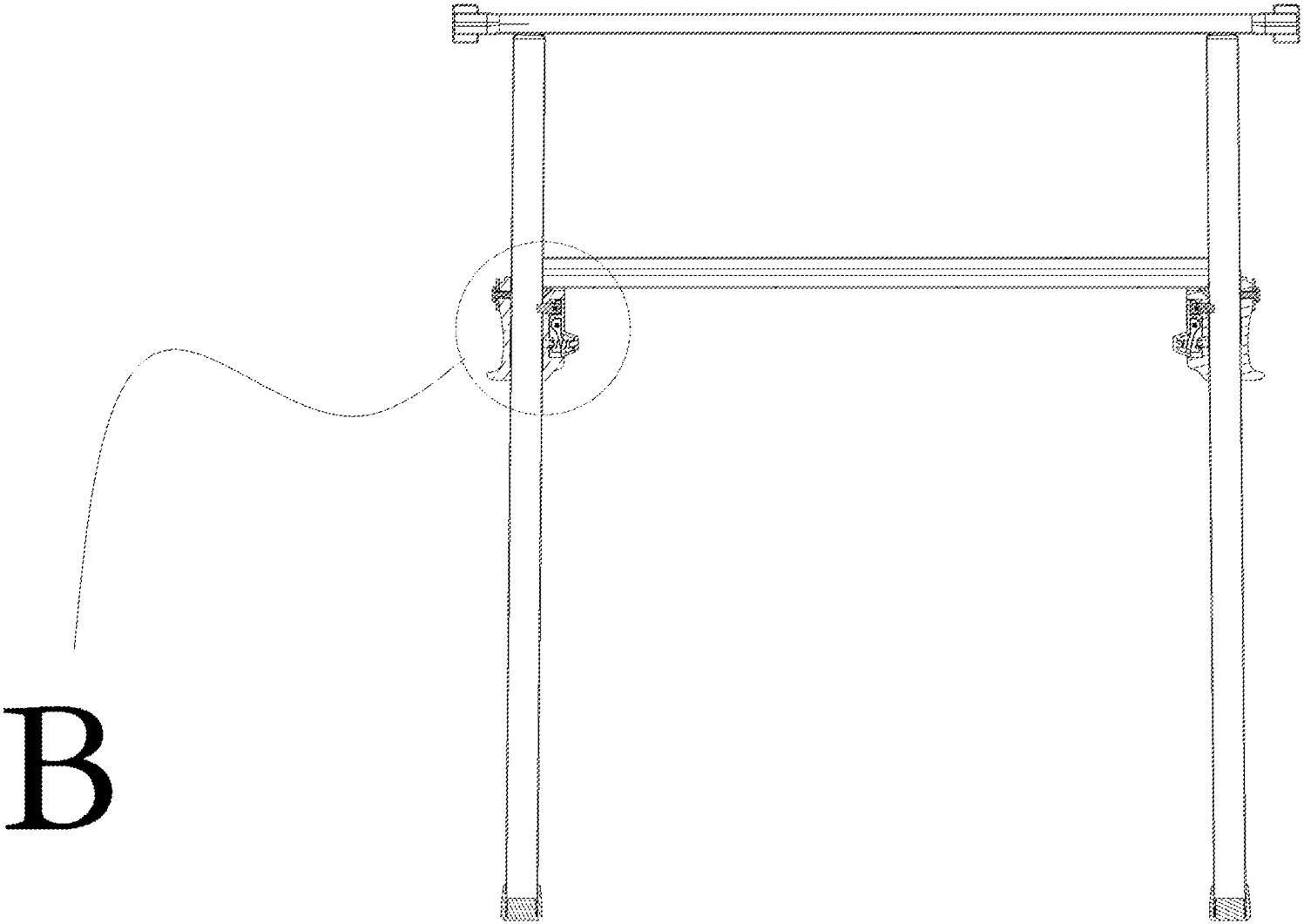
FIG. 7 is a cross-sectional view illustrating the coupling of an exemplary slider with a leg in accordance with exemplary embodiments of the present disclosure.
Figure 8:
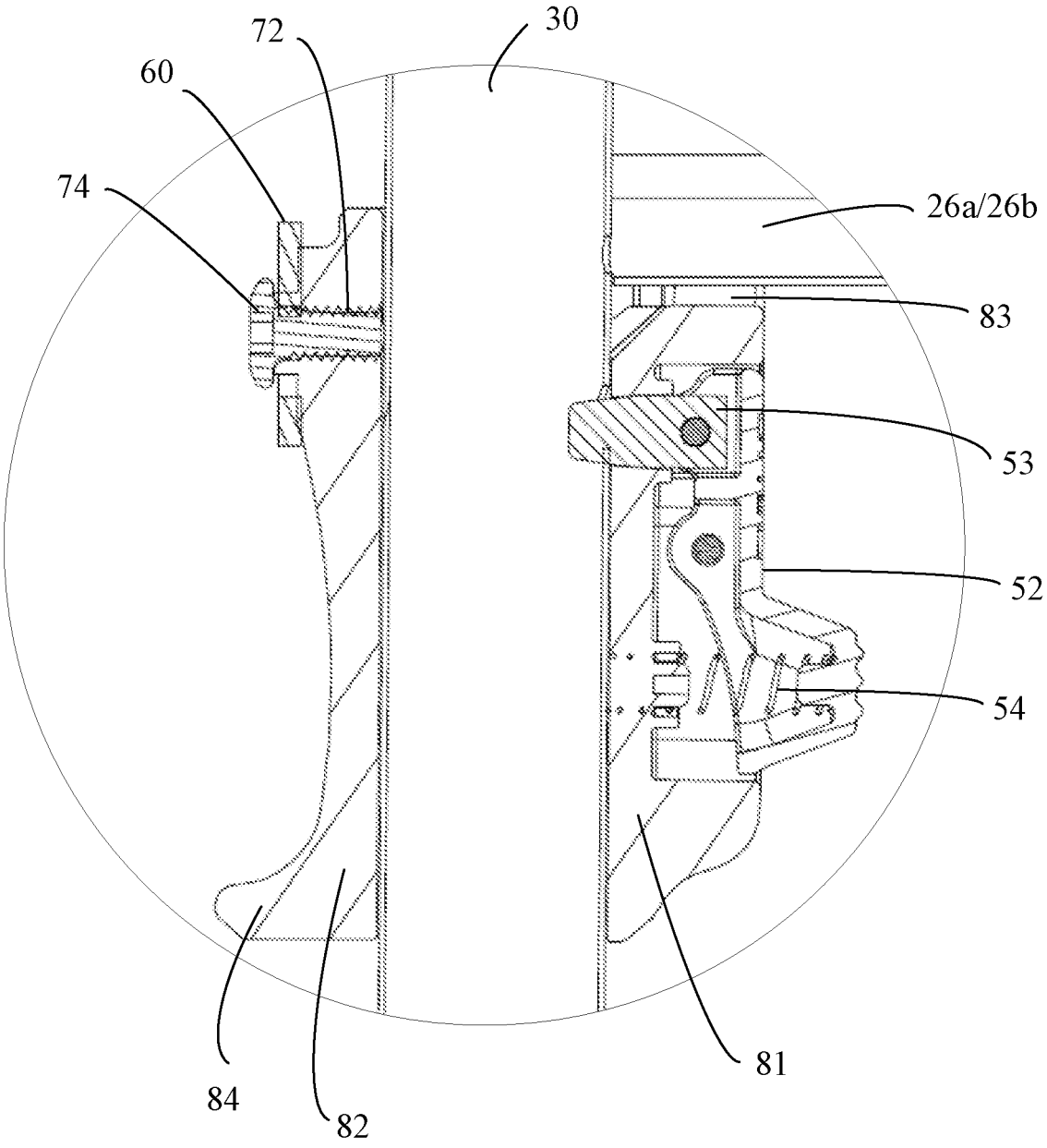
FIG. 8 is an enlarged view taken along circle B of FIG. 7.
Figure 9:
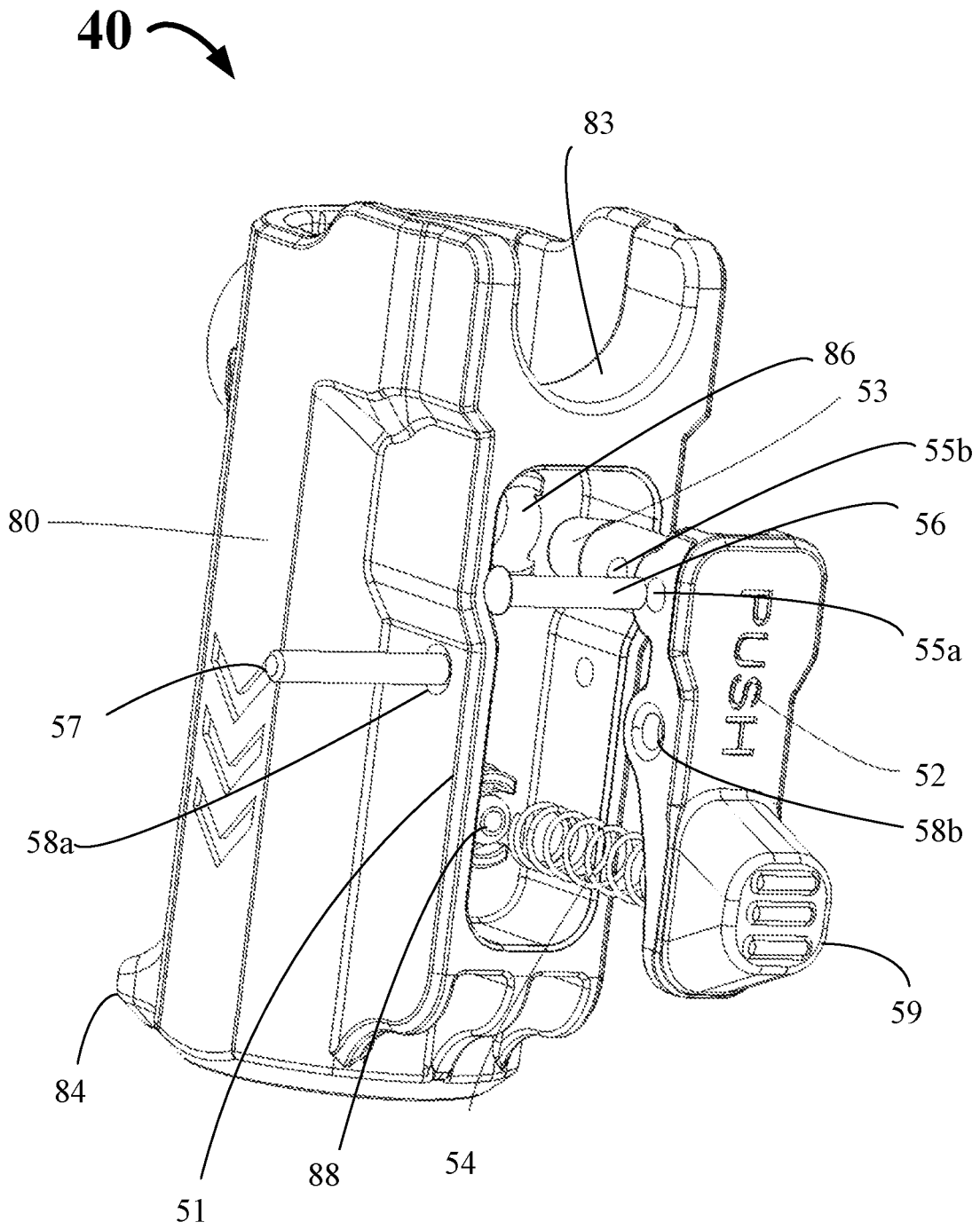
FIG. 9 is a disassembled view illustrating an exemplary slider in accordance with exemplary embodiments of the present disclosure.

Referring to FIGS. 7-9, there is depicted an exemplary slider in accordance with some exemplary embodiments of the present disclosure. As shown, slider 40 includes a sleeve such as sleeve 80 configured to slidably couple with a first bar such as leg 30. In some exemplary embodiments, sleeve 80 includes a first side wall such as first side wall 81 and a second side wall 82. In some exemplary embodiment, each of the first and second side walls is a portion of a circumferential wall of the sleeve. In an exemplary embodiment, the first and second side walls are on opposite sides of the sleeve with respect to each other. A hole such as hole 86 and a pillar such as pillar 88 are formed at first side wall 81. In some exemplary embodiments, hole 86 and pillar 88 are formed at the first side wall of the sleeve side by side along the longitudinal direction of the sleeve. In an exemplary embodiment, hole 86 is formed at a middle portion of the first side wall of the sleeve.

In some exemplary embodiments, pivoting portion 70 is integrally formed (e.g., by molding) or coupled (e.g., glued or fastened) with the second side wall of the sleeve and configured to pivotally couple with a second bar such as the oblique bar. For instance, in an exemplary embodiment, pivoting portion 70 includes a hole such as hole 72 formed at the second side wall of the sleeve and a fastener such as fastener 74 that couples with hole 72.

Controller 50 is configured to control movement of the sleeve along the first bar such as leg 30. In some exemplary embodiments, controller 50 includes casing 51 integrally formed (e.g., by molding) or coupled (e.g., glued or fastened) with the first side wall of the sleeve. Casing 51 can have any suitable shapes provided that it encloses or surrounds hole 86 and pillar 88 formed at first side wall 81. In an exemplary embodiment, casing 51 is formed by one or more walls extended from the first side wall of the sleeve, e.g., a portion of the first side wall serves as the bottom of casing 51.

Controller 50 also includes a lever such as lever 52 pivotally connected with casing 51. For instance, in some exemplary embodiments, lever 52 includes a first end portion aligned with hole 86 of the sleeve, a second end portion aligned with pillar 88 of the sleeve, and a middle portion between the first and second portions. In an exemplary embodiment, the middle portion of the lever is pivotally connected with the casing by a rod such as rod 57 passing through a hole such as hole 58*a* formed at the casing and a hole such as hole 58*b* formed at the middle portion of the lever.

Controller 50 also includes a pin such as pin 53 integrally formed or coupled with the first end portion of the lever and having a free end toward hole 86 formed at the first side wall of the sleeve. For instance, in an exemplary embodiment, pin 53 is coupled with the first end portion of the lever by a rod such as rod 56 that passes a hole such as hole 55*a* formed at the first portion of the lever and a hole such as hole 55*b* formed at the pin.

Controller 50 further includes an elastic member such as elastic member 54 engaged with pillar 88 formed at the first side wall of the sleeve. Elastic member 54 has a first end abutting the bottom of the casing (e.g., the first side wall of the sleeve) and a second end abutting the second portion of the lever. Thus, when hole 86 formed at the first side wall of the sleeve aligns with a hole or slot of the leg such as hole or slot 31, elastic member 54 pushes the free end of pin 53 into hole 86 and the hole at the leg, thereby restricting the sleeve (and accordingly the slider) from moving along the leg.

Pressing the second portion of the lever toward the sleeve will remove the free end of pin 53 from the hole at the leg or from the hole at the leg and hole 86 formed at the first side wall of the sleeve. This disengages the sleeve from the leg, and thus allows the sleeve (accordingly the slider) to move along the leg. In some exemplary embodiments, the second portion of the lever includes a protrusion such as protrusion 59 that is protruded outside of the casing to facilitate easy pressing of the second portion of the lever.

In some exemplary embodiments, slider 40 includes additional, optional or alternative features. For instance, in some exemplary embodiments, a notch such as notch 83 is formed at the upper end portion of first side wall 81 of the sleeve and configured to couple with a bar such as the first or second leg lateral bar when the leg is unfolded. In some exemplary embodiments, a protrusion such as protrusion 84 is formed at the sleeve to facilitate easy pushing of the slider along the leg. In an exemplary embodiment, protrusion 84 is formed at second side wall 82 of the sleeve.

It should be noted that slider 40 can couple with any suitable bars or legs including but not limited leg 30 disclosed herein, and accordingly slider 40 can be used in applications including but not limited to table frames disclosed herein. For instance, slider 40 can be used in other furniture such as chairs, beds or the like.

Figure 5:
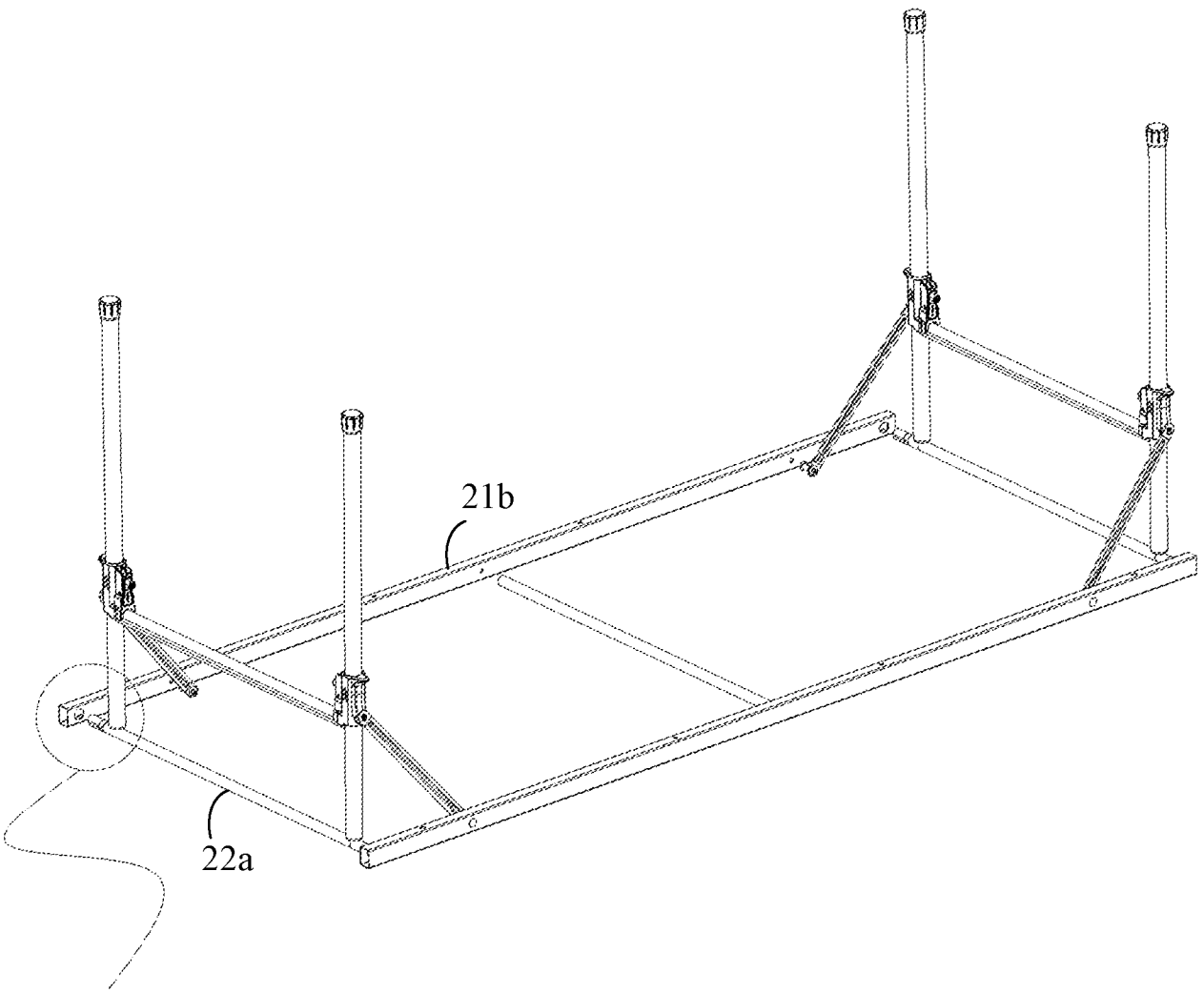
FIG. 5 is a partially disassembled view illustrating the exemplary frame of in FIG. 2 in accordance with exemplary embodiments of the present disclosure.
Figure 6:
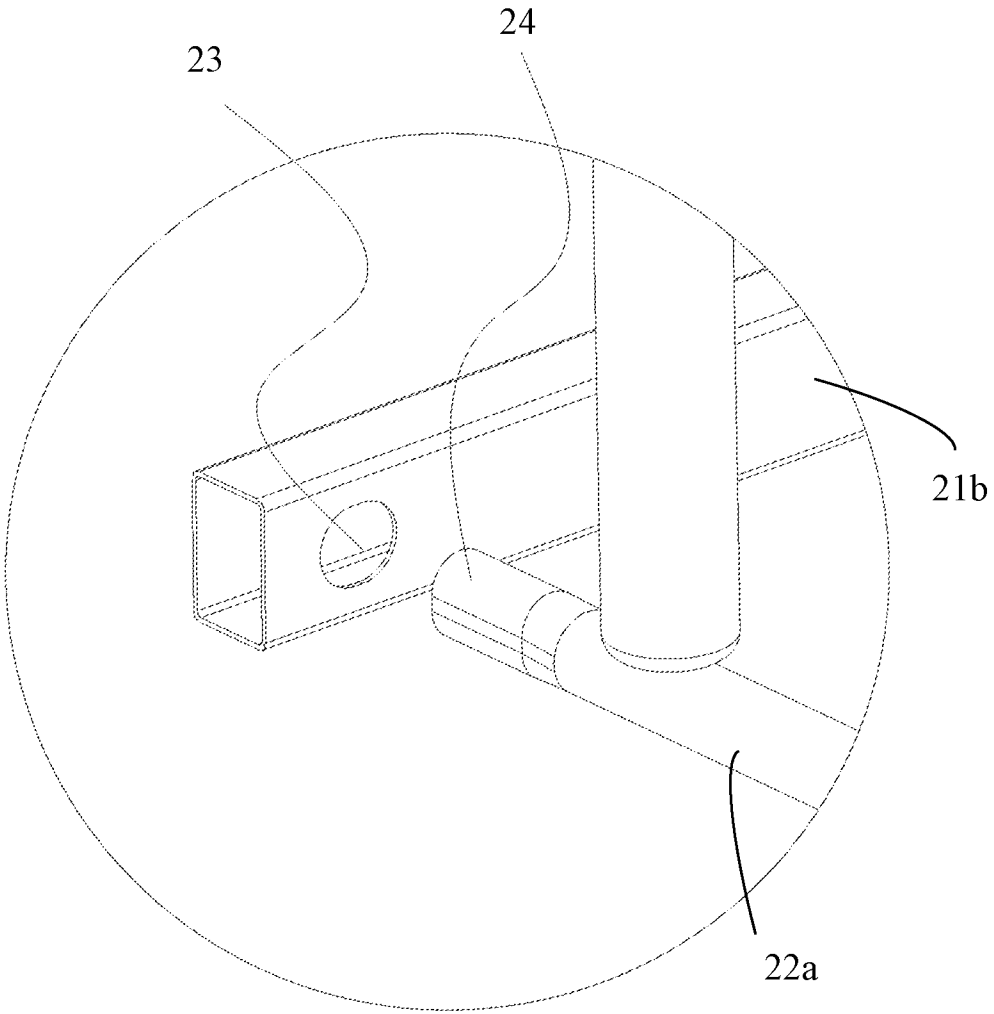
FIG. 6 is an enlarged view taken along circle A of FIG. 5.

Referring to FIGS. 5 and 6, in some exemplary embodiments, each of the first and second longitudinal bars is formed with a hole such as hole 23 at each of the third and fourth sides of the frame (e.g., adjacent the two ends of the first or second longitudinal bar), and each of the first and second lateral bars includes an engaging portion such as engaging portion 24 configured to be inserted into the hole formed at the first or second longitudinal bar. In some exemplary embodiments, one of hole 23 and engaging portion 24 has an oval or oblong cross-section, or each of hole 23 and engaging portion 24 has an oval or oblong cross-section. For instance, in an exemplary embodiment, the width of hole 23 (e.g., in the longitudinal direction of the frame) is larger than the height of hole 23 (e.g., in the vertical direction of the frame), the width of engaging portion 24 is smaller than the height of engaging portion 24, and the height of engaging portion 24 matches with the height of hole 23. As such, the lateral and longitudinal bars are loosely coupled with each other when the leg is folded onto the tabletop, and the lateral and longitudinal bars are tightly coupled with each other when the leg is unfolded and supports the tabletop. This configuration makes it easy to fold and unfold the legs and helps to stabilize the table when in use.

The frames and tables of the present disclosure have several advantages. For instance, the tables and frames requires no substantial assembling by end users. The legs can be folded or unfolded by the control of sliders 40, thereby reducing the sizes of the frames and tables when folded. Further, the configuration and coupling of hole 23 and engaging portion 24 enhance the stability of the frames and tables.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A slider comprising:

a sleeve configured to slidably couple with a first bar and comprising a first side wall and a second side wall, wherein a first hole and a pillar are formed at the first side wall of the sleeve;

a pivoting portion integrally formed or coupled with the second side wall of the sleeve, and configured to pivotally couple with a second bar, wherein the pivoting portion has a pivoting axis substantially perpendicular to the second side wall of the sleeve; and a controller configured to control movement of the sleeve along the first bar, wherein the controller comprises:

a casing integrally formed or coupled with the first side wall of the sleeve and surrounding the first hole and the pillar formed at the first side wall of the sleeve;

a lever comprising a first end portion aligned with the first hole formed at the first side wall of the sleeve, a second end portion aligned with the pillar formed at the first side wall of the sleeve, and a middle portion between the first and second portions and pivotally connected with the casing;

a pin integrally formed or coupled with the first end portion of the lever, wherein the pin has a free end toward the first hole formed at the first side wall of the sleeve; and an elastic member engaged with the pillar formed at the first side wall of the sleeve, the elastic member having a first end abutting the first side wall of the sleeve and a second end abutting the second portion of the lever, wherein when the first hole formed at the first side wall of the sleeve aligns with a hole of the first bar, the elastic member pushes the pin into the first hole formed at the first side wall of the sleeve and the hole of the first bar, thereby restricting movement of the sleeve with respect to the first bar.

2. The slider of claim 1, wherein the first hole and the pillar are formed at the first side wall of the sleeve side by side along the longitudinal direction of the sleeve.

3. The slider of claim 1, wherein the first and second side walls of the sleeve are opposite to each other.

4. The slider of claim 1, wherein a protrusion is formed at the second side wall of the sleeve to facilitate easy pushing of the slider along the first bar.

5. The slider of claim 1, wherein the lever is pivotally coupled with the casing by a rod that passes through a hole formed at a middle portion of the casing and a hole formed at the middle portion of the lever.

6. The slider of claim 1, wherein the pin is coupled with the first end portion of the lever by a rod that passes through a hole formed at the first portion of the lever and a hole formed at the pin.

7. The slider of claim 1, wherein pressing the second portion of the lever toward the sleeve removes the pin from the hole of the first bar or from the hole of the first bar and the first hole formed at the first side wall of the sleeve, thereby allowing the sleeve to move along the first bar.

8. The slider of claim 1, wherein the second portion of the lever comprises a protrusion outside of the casing to facilitate the pressing of the second portion.

9. The slider of claim 1, wherein the pivoting portion comprises:

a hole formed at the second side wall of the sleeve and oriented substantially perpendicular to the second side wall of the sleeve; and a fastener that couples with the hole.

10. A slider comprising:

a sleeve configured to slidably couple with a first bar and comprising a first side wall and a second side wall, wherein a first hole and a pillar are formed at the first side wall of the sleeve;

a pivoting portion integrally formed or coupled with the second side wall of the sleeve, and configured to pivotally couple with a second bar; and a controller configured to control movement of the sleeve along the first bar, wherein the controller comprises:

a casing integrally formed or coupled with the first side wall of the sleeve and surrounding the first hole and the pillar formed at the first side wall of the sleeve;

a lever comprising a first end portion aligned with the first hole formed at the first side wall of the sleeve, a second end portion aligned with the pillar formed at the first side wall of the sleeve, and a middle portion between the first and second portions and pivotally connected with the casing;

a pin integrally formed or coupled with the first end portion of the lever, wherein the pin has a free end toward the first hole formed at the first side wall of the sleeve; and an elastic member engaged with the pillar formed at the first side wall of the sleeve, the elastic member having a first end abutting the first side wall of the sleeve and a second end abutting the second portion of the lever, wherein when the first hole formed at the first side wall of the sleeve aligns with a hole of the first bar, the elastic member pushes the pin into the first hole formed at the first side wall of the sleeve and the hole of the first bar, thereby restricting movement of the sleeve with respect to the first bar, wherein a notch is formed at an end portion of the first side wall of the sleeve and configured to couple with a third bar.

11. A frame comprising:

a first longitudinal bar disposed at a first side of the frame;

a second longitudinal bar disposed at a second side of the frame and substantially parallel to the first longitudinal bar;

a first lateral bar disposed at a third side of the frame and having a first end pivotally connected with the first longitudinal bar and a second end pivotally connected with the second longitudinal bar;

a second lateral bar disposed at a fourth side of the frame and having a first end pivotally connected with the first longitudinal bar and a second end pivotally connected with the second longitudinal bar;

a plurality of legs, each having an end fixedly connected with the first or second lateral bar;

a plurality of oblique bars, each having a first end and a second end, wherein the first end of each respective oblique bar in the plurality of oblique bars is pivotally connected with the first or second longitudinal bar; and a plurality of sliders, each comprising:

a sleeve slidably coupled with a corresponding leg in the plurality of legs, wherein a first hole and a pillar are formed at a first side wall of the sleeve;

a pivoting portion integrally formed or coupled with a second side wall of the sleeve, and pivotally coupled with the second end of an oblique bar in the plurality of oblique bars, wherein the pivoting portion has a pivoting axis substantially perpendicular to the second side wall of the sleeve; and a controller configured to control movement of the sleeve along the corresponding leg, wherein the controller comprises:

a casing integrally formed or coupled with the first side wall of the sleeve and surrounding the first hole and the pillar formed at the first side wall of the sleeve;

a lever comprising a first end portion aligned with the first hole formed at the first side wall of the sleeve, a second end portion aligned with the pillar formed at the first side wall of the sleeve, and a middle portion between the first and second portions and pivotally connected with the casing;

a pin integrally formed or coupled with the first end portion of the lever, wherein the pin has a free end toward the first hole formed at the first side wall of the sleeve; and an elastic member engaged with the pillar formed at the first side wall of the sleeve, the elastic member having a first end abutting the first side wall of the sleeve and a second end abutting the second portion of the lever, wherein when the first hole formed at the first side wall of the sleeve aligns with a hole of the first or second longitudinal bar, the elastic member pushes the pin into the first hole formed at the first side wall of the sleeve and the hole of the first or second longitudinal bar, thereby restricting movement of the sleeve with respect to the first or second longitudinal bar.

12. The frame of claim 11, further comprising one or more interior lateral bars spaced apart from the first and second lateral bars, wherein each interior bar in the one or more interior bars has a first end connected with the first longitudinal bar and a second end connected with the second longitudinal bar.

13. The frame of claim 12, wherein the one or more interior lateral bars comprises a middle interior lateral bar disposed in a middle of the frame.

14. The frame of claim 11, wherein each slider in the plurality of sliders is coupled with the corresponding leg such that the controller faces an interior side of the frame and the pivoting portion faces an exterior side of the frame.

15. The frame of claim 11, wherein each of the first and second longitudinal bars is formed with an oval or oblong hole at a distal end thereof, and each of the first and second lateral bars comprises an end portion of an oval or oblong cross-section at each of the first and second sides of the frame to couple with the oval or oblong hole.

16. The frame of claim 11, wherein a length of each leg in the plurality of legs is adjustable.

17. A table comprising:

the frame of claim 11; and a tabletop coupled with the frame and supported by the frame when in use.

18. The table of claim 17, wherein each of the first and second longitudinal bars is a unitary bar and the tabletop is a unitary panel.

19. The table of claim 17, wherein the frame comprises one or more interior lateral bars spaced apart from the first and second lateral bars, wherein each interior bar in the one or more interior bars has a first end connected with the first longitudinal bar and a second end connected with the second longitudinal bar, and corresponding to an interior lateral bar in the one or more interior lateral bars, the tabletop comprises one or more slots to receive the interior lateral bar.

20. A frame comprising:

a first longitudinal bar disposed at a first side of the frame;

a second longitudinal bar disposed at a second side of the frame and substantially parallel to the first longitudinal bar;

a first lateral bar disposed at a third side of the frame and having a first end pivotally connected with the first longitudinal bar and a second end pivotally connected with the second longitudinal bar;

a second lateral bar disposed at a fourth side of the frame and having a first end pivotally connected with the first longitudinal bar and a second end pivotally connected with the second longitudinal bar;

a plurality of legs, each having an end fixedly connected with the first or second lateral bar;

a plurality of oblique bars, each having a first end and a second end, wherein the first end of each respective oblique bar in the plurality of oblique bars is pivotally connected with the first or second longitudinal bar;

a plurality of sliders, each comprising:

a sleeve slidably coupled with a corresponding leg in the plurality of legs, wherein a first hole and a pillar are formed at a first side wall of the sleeve;

a pivoting portion integrally formed or coupled with a second side wall of the sleeve, and pivotally coupled with the second end of an oblique bar in the plurality of oblique bars; and a controller configured to control movement of the sleeve along the corresponding leg, wherein the controller comprises:

a casing integrally formed or coupled with the first side wall of the sleeve and surrounding the first hole and the pillar formed at the first side wall of the sleeve;

a lever comprising a first end portion aligned with the first hole formed at the first side wall of the sleeve, a second end portion aligned with the pillar formed at the first side wall of the sleeve, and a middle portion between the first and second portions and pivotally connected with the casing;

a pin integrally formed or coupled with the first end portion of the lever, wherein the pin has a free end toward the first hole formed at the first side wall of the sleeve; and an elastic member engaged with the pillar formed at the first side wall of the sleeve, the elastic member having a first end abutting the first side wall of the sleeve and a second end abutting the second portion of the lever, wherein when the first hole formed at the first side wall of the sleeve aligns with a hole of the first or second longitudinal bar, the elastic member pushes the pin into the first hole formed at the first side wall of the sleeve and the hole of the first or second longitudinal bar, thereby restricting movement of the sleeve with respect to the first or second longitudinal bar;

a first leg lateral bar disposed between and fixedly connected with two legs that are connected with the first lateral bar; and a second leg lateral bar disposed between and fixedly connected with two legs that are connected with the second lateral bar, wherein of each slider in the plurality of sliders, a notch is formed at an upper end portion of the first side wall of the sleeve and configured to couple with the first or second leg lateral bar when the legs are unfolded.

* * * * *